United States Patent [19]

Brunner et al.

[11] Patent Number: 4,879,945

[45] Date of Patent: Nov. 14, 1989

[54] HYDRAULIC CONTROL DEVICE

[75] Inventors: Rudolf Brunner, Baldham; Heiner Fichtenbeiner, Gröbenzell, both of Fed. Rep. of Germany

[73] Assignee: Heilmeier & Wienlein, Fabrik fur Oel-Hydraulik GmbH & Co. KG, Fed. Rep. of Germany

[21] Appl. No.: 215,061

[22] Filed: Jul. 5, 1988

[30] Foreign Application Priority Data

Jul. 3, 1987 [DE] Fed. Rep. of Germany ..... 3722083

[51] Int. Cl.[4] ..... F15B 11/00

[52] U.S. Cl. ..... 91/518; 60/468; 91/530

[58] Field of Search ..... 60/427, 484, 468; 91/508, 518, 530

[56] References Cited

U.S. PATENT DOCUMENTS 3,411,295 11/1968 Byers, Jr. ..... 91/530 X
4,739,617 4/1988 Kreth et al. ..... 91/523 X

FOREIGN PATENT DOCUMENTS 2030382 12/1971 Fed. Rep. of Germany ..... 91/530
2457451 6/1976 Fed. Rep. of Germany ..... 91/530

*Primary Examiner*—Edward K. Look
*Attorney, Agent, or Firm*—Kinzer, Plyer, Dorn, McEachran & Jambor

[57] ABSTRACT

In a hydraulic control device having at least one distributing valve (2m, 2') connected upstream of a consuming point (35), a more effective energy utilization is achieved by means of a pressure step (D) provided for the input pressure of a second throttling point (15), which can be switched in stroke-dependent fashion by means of a control element (17, 17') of the distributing valve (2, 2') so that the maximum difference in pressure between the pump line pressure $P_{(4)}$ and the consumer pressure $P_{(3)}$ is only controlled shortly before the need of a high conveying amount. Before this the difference in pressure is kept smaller.

10 Claims, 4 Drawing Sheets

1A
2
3
3'
3a
3b
3c
4
5
6
7
8
9
10
11
12
12'
12a
13
14
15
15'
15a
15b
16
17
18
19
20
21
22
23
24
24a
25
26
27
28
29
30
31
32
33
34
35
36
37
D

HYDRAULIC CONTROL DEVICE

The invention relates to a hydraulic control device.

In a hydraulic control device of this type known from the U.S. Pat. No. 3,971,216 the input pressure of the second throttling point is increased above the load pressure by the fact that the pressure medium flowing to the distributing valve has to overcome the force of a prestressed valve in the second control line. This increased control pressure is supplied to the spring side of the pressure balance to correspondingly increase the pump pressure. It is certainly provided in an embodiment of this hydraulic control device to connect a second throttling point in series downstream in addition to the prestressed valve biased by the spring to achieve for a working direction of the cylinder which can be acted upon on both sides a higher increase in pressure than for the other working direction. However, the increase in pressure is controlled across the entire working range of the control element of the distributing valve to the same extent so that there is substantially the same difference between the pressure in the pump line and the consumer pressure across the entire working range until the maximum conveying amount is achieved. However, the maximum difference in pressure is only required for achieving the maximum conveying amount in the control position end position of the control element of the distributing valve. Energy is wasted in the control positions within the stroke of the control element from the neutral position up to close to the control position end position due to the high difference in pressure being then unnecessary, which can lead to heating and a too great mechanical wear of the pressure medium. This control device requires moreover alternating valves in the control line circuit to supply the maximum load pressure from one of the distributing valves to the pressure balance in each case. The disadvantage results from this that upon the simultaneous actuation of several distributing valves, the distributing valves being provided for consuming points with smaller conveying amounts, are supplied with too great an amount of pressure medium, which leads possibly to damage or risks. For this purpose an inlet controller is associated to eac' distributing control valve, which throttles as a function of the load pressure as soon as the pressure balance adjusts a too high pressure in the pump line in the other distributing valve. However, this is an expensive additional expenditure.

The advantage of a uniform increase in pressure is also given in a hydraulic control device which is known from the U.S. Pat. No. 3,815,477, because the second throttling point is unchangedly operative across the entire stroke path of the control element of the distributing valve.

The invention is based on the object to create a hydraulic control device of the type mentioned at the beginning which is distinguished by an improved energy utilization and a careful treatment of the pressure medium.

In this design a stepwise pressure increase is achieved which is controlled as a function of the stroke movement of the control element of the distributing valve. The second throttling point in the control line circuit acts in such fashion that it adjusts at first a specific lower increase in pressure ia the pressure balance, at which it is ensured that the pump line pressure is certainly above the consuming point pressure, but only to such an extend that the same provides for the proper load-independent movement of the consuming point across an initial stroke with smaller conveying amount. Only towards the end of the stroke path of the control element of the distributing valve the pressure in the pump line is increased at least in one step to such an extent that the maximum conveying amount or the maximum speed of the consuming point are achieved without problems. This results in an improved energy utilization and in the advantage that the pressure means is subjected to a lesser mechanical strain and is not heated that much, because the pressure medium flows off via the pressure balance with little flow resistance across the initial range of the stroke path of the control element of the distributing valve.

An especially suitable embodiment of the invention is one in which the second throttling point is subdivided into two parallel throttles, one of which being disabled towards the end of the stroke path of the control element of the distributing valve so that then a higher flow resistance results in the second control line, from which the step in the increase in pressure results. In the case of a smaller conveying amount to the consuming point the flow resistance is on the other hand reduced due to the two throttles of the second throttling point being then operative and also the increase in pressure is smaller. The transition between the two steps of the pressure increase is not noticeable at the consuming point. It would also be conceivable to bifurcate the second control line into more than two parallel lines and to provide a throttle of its own in each line to achieve more than two steps in the pressure increase via the stroke path of the control element.

An alternative embodiment is one in which only one throttle is provided as second throtting point in the second control line in conventional fashion. However at the same time it is ensured that a further flow path is opened towards the end of the stroke movement of the control element into the control position end position, from which the pressure medium from the pump lines flows directly into the control line circuit. This additional pressure medium increases the amount of pressure medium which is to flow in the control line circuit via the second throttling point so that in this fashion the input pressure of the second throttling point is increased and the force at the spring side of the pressure balance is increased.

A further suitable embodiment is one in which the step of the pressure increase can be practically optionally controlled as a function of the application of the hydraulic control device. Due to the fact that the larger throttle of the second throttling point is separated towards the end of the stroke path of the control element of the distributing valve, a clear increase in pressure results at the spring side of the pressure balance. However, it could also be proceeded conversely so that the step of the pressure increase is only smaller.

One embodiment which has especially proved its worth in practice is that which is designed for a maximum conveying amount of approx. 80 l/min., the desired and predeterminable conveying amount being achieved across the entire working range of the distributing valve. Despite this the pressure medium was cooler due to the measured relatively small difference in pressure between the pump line pressure and the consuming point pressure in the initial phase of the stroke of the distributing valve during a test series than the pressure medium in the case of a conventional control of the pressure increase.

Another embodiment furthermore of importance is one which assures that the input pressure of the first throttling point becomes duly operative in the control line circuit at the side opposite to the spring side of the pressure balance, i.e. that the pressure medium cannot look for the path with less resistance via the secondary control duct. Possibly an additional influence can be exerted on the course of the steps of the pressure increase by a suitable coordination between the first throttling point and the throttle in the secondary control duct or in the connecting duct.

A further suitable embodiment of the subject matter of the invention is one in which several distributing valves are connected in parallel to the pump line and the control line circuit. In this design the return valve does not only prevent the reduction of the load by any pressure medium pressed back into the control line circuit, but it also ensures that in the case of another distributing valve with lower load pressure fed into the control line circuit, which is operated with a lead, there is no step in the pressure increase due to this higher load pressure if the distributing valve associated to the return valve is retardedly switched on, which possibly triggers a higher load pressure, which would be dangerous for the other distributing valves or their consuming points. Then the distributing valve with the higher load pressure is uncoupled by the return valve from the control line circuit and the pressure in the control line circuit is controlled with the lower load pressure having priority. This is in particular an extremely important property of the control device in stacker trucks or forklifts, because there the lifting cylinder works customarily with the maximum load pressure, while inclining cylinders or other auxiliary cylinders must work with lower load pressures. A dangerous interaction would result, if the higher load pressure would not be intercepted at the return valve.

A further suitable embodiment is one in which the return valve has been allocated a double function, by forming both the second throttling point and by suppressing also the retroaction of the high load pressure in the control line circuit, which might be disturbing. This is also a favorable measure in production technology respect.

Another embodiment has proven to be especially suitable in practice, in particular for stacker tracks and forklifts because 80% of the stroke path of the control element of the distributing valve a high difference in pressure between the pump line pressure and the consumer line pressure is only required in practice. This high difference in pressure meant previously only a waste of energy at the expense of the temperature of the pressure medium which increases its mechanical load superfluously.

A further embodiment is one which includes an especially suitable accommodation of the second throttling point which makes it also possible to control the pressure increase only for one working direction of the consuming point. It would furthermore be conceivable to select the cross section of the bleeding line small so that the same acts as second throttling point in the control line circuit The embodiments of the subject matter of the invention are explained in the following by means of the drawing.

Figure 3:
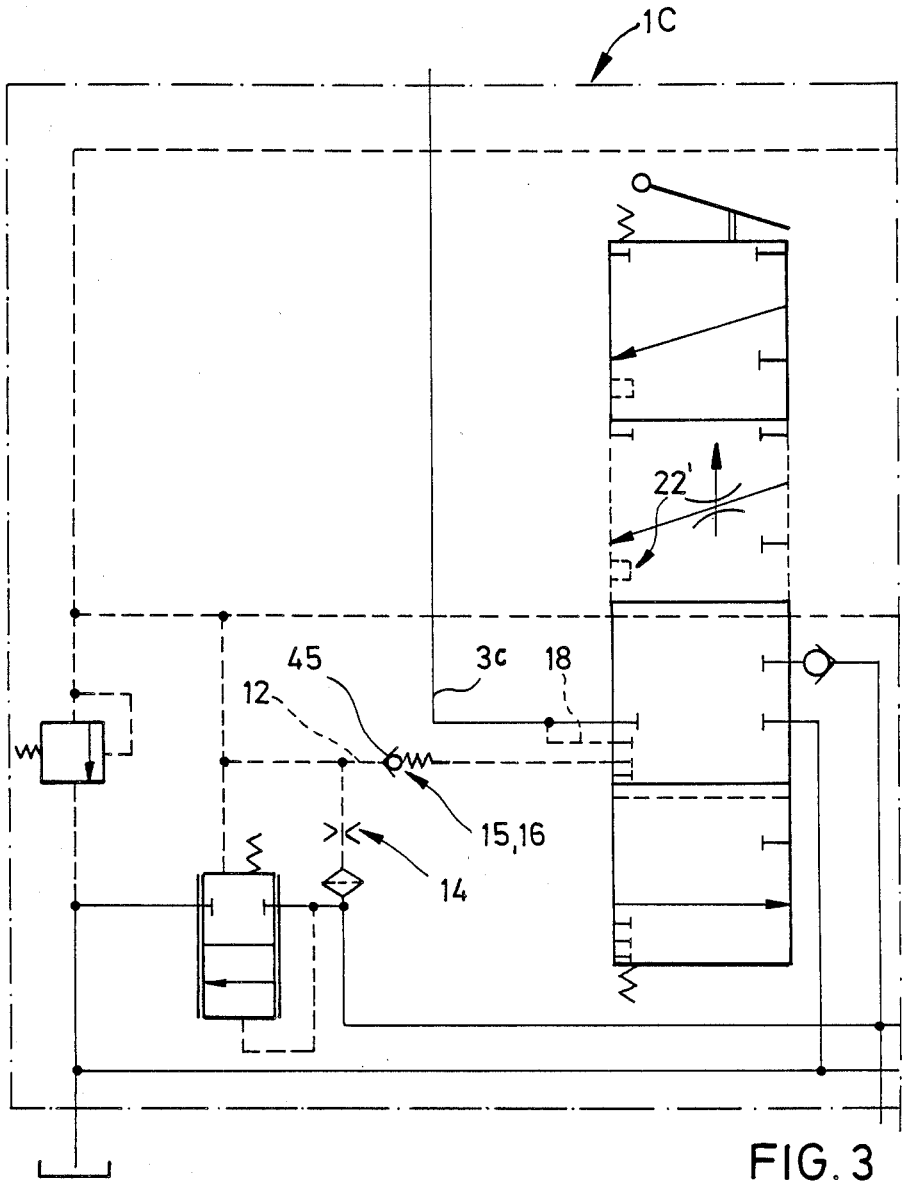
FIG. 3 shows part of a further embodiment in a wiring diagram and in simplified representation.
Figure 3A:
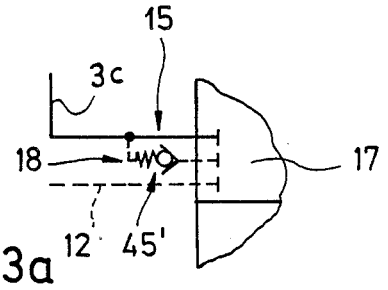

FIG. 3*a* shows a detail of a further embodiment variant; and

Figure 4:
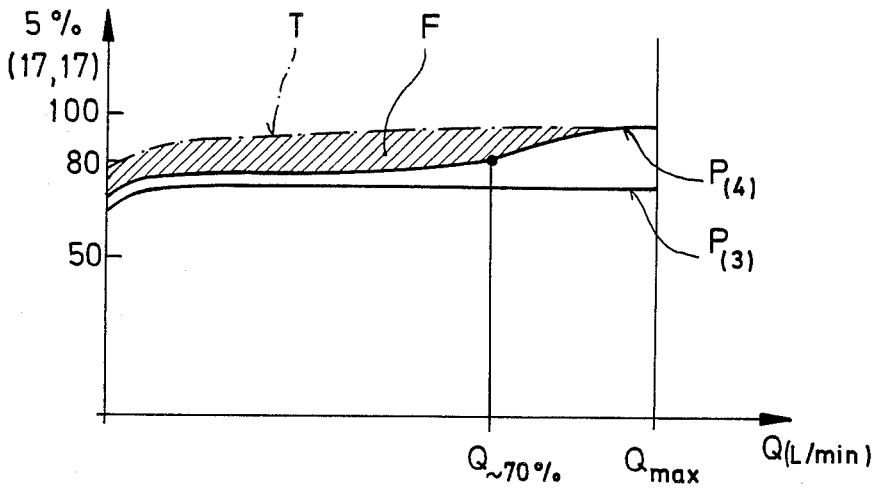

FIG. 4 shows a diagram to illustrate the working method of the control devices according to the preceeding FIGS.

Figure 1:
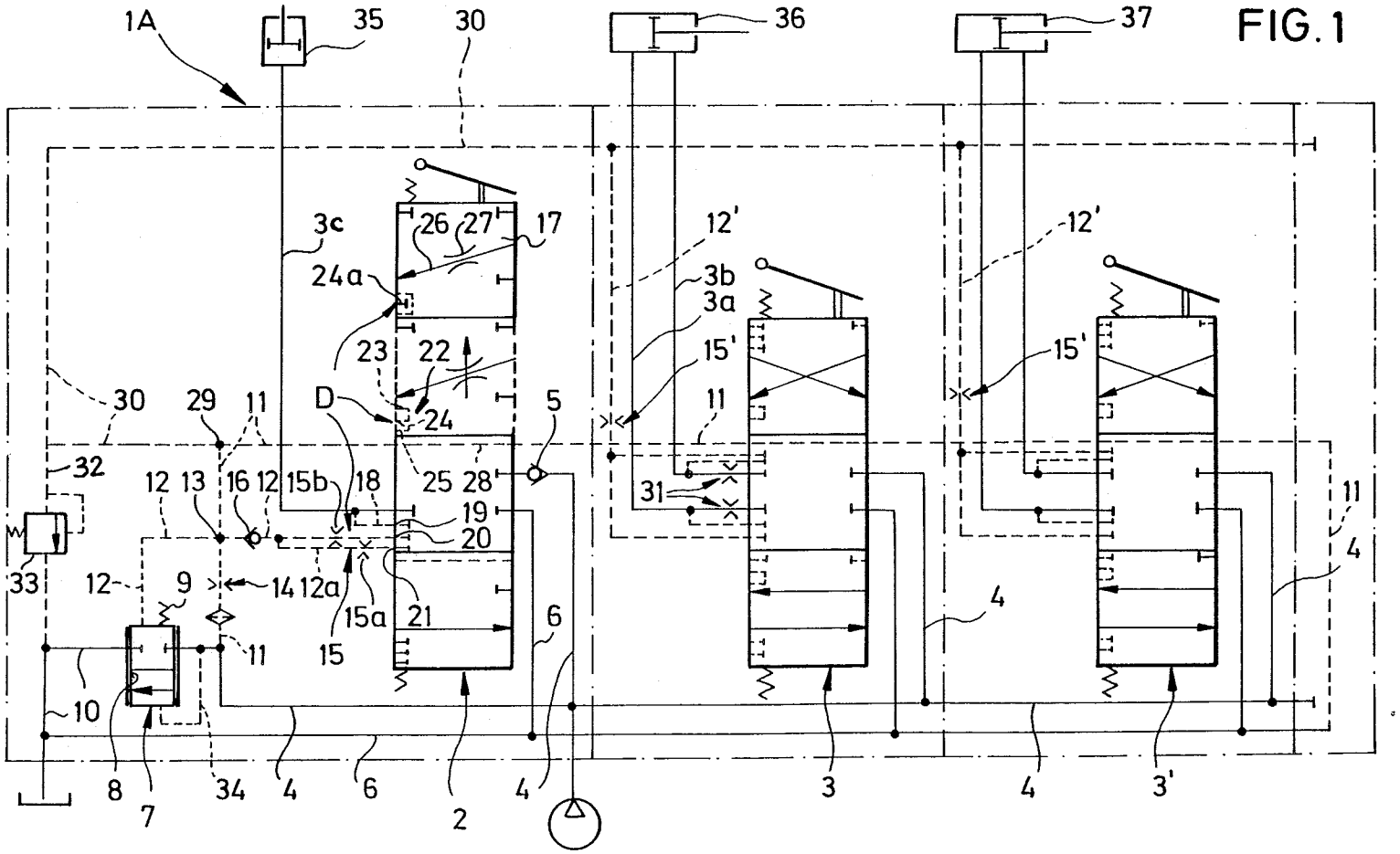
FIG. 1 shows a wiring diagram of a first embodiment of a hydraulic control device.

A hydraulic control device 1A according to FIG. 1 which is for instance intended for a stacker truck or a forklift contains three distributing valves 2, 3 and 3', which are connected in parallel to each other to a pump line and to which pressure medium is supplied from a pressure source, e.g. a fixed displacement pump. A return valve 5 is provided before each distributing valve 2, 3 and 3' in the pump line 4. The distributing valves 2, 3, 3' are connected to a joint return line 6 to a tank. A pressure balance 7 of customary construction is provided in the pump line 4, which contains a slide which is continuously adjustable between a locking position (FIG. 1) and a passage position and can establish a more or less throttled connection from the pump line 4 to the return line 6 via a line 10. The slide 8 of the pressure balance 7 is loaded by a spring 9 in the direction to its locking position, which is very weak (rotating pressure being as small as possible).

A control line circuit consists of a first control line 11, a second control line 12, a third control line 34 and a control line circuit element 30 connected to the first control line 11 at 29. The first control line 11 branches off from the pump line 4 and leads to the distributing valve 2 and via the same to the return via further distributing valves 3 and 3'. An adjustable control element 17 contains in each distributing valve a passage duct 28, which connects the first control line 11 to the return line 6 in the neutral position. The second control line 12 leads from the spring side of the pressure balance 7 at first to a connecting point 13 with a first control line 11 and from the connecting point 13 to the distributing valve 2. A first throttling point 14 is provided in the first control line 11 between the pump line 4 and the connecting point 13. A second throttling point 15 is provided in the second control line 12 between the intersection 13 and the distributing valve 2. The input pressure of the first throttling point 14 is transmitted by means of the third control line 34 to the side of the slide 8 of the pressure balance 7 which is opposite to the spring side. The input pressure of the second throttling point 14 is operative via the second control line 12 at the spring side of the pressure balance 7. A return valve 16 is provided in the second control line 12 between the connecting point 13 and the second throttling point 15, which is open in flow direction to the distributing valve 2. The second control line 12 is bifurcated behind the return valve 15 in two parallel branches **12*a* and 12*b*, each of which contains a part of the throttle 15*a* and 15*b* forming the throttling point 15. The two parallel branches 12*a* and 12*b* are connected to separate load pressure bleeding connections 20, 21** in the distributing valve.

The throttle cross section of the first throttling point 14 is larger in this design than the sum of the throttling cross sections of the throttles **15*a* and 15*b*. The throttle 15*b* has a larger throttle cross section than the throttle 15*a***.

The control element 17 is adjustable in the distributing valve 2 in conventional fashion from the neutral position into two control position end positions, an intermediate position of the control element 17 being outlined with a broken line in FIG. 1, in which the same has carried out still less than for instance 80% of the stroke in the direction to the first control position end position The distributing valve 2 serves for controlling a consuming point, e.g. a simply acting cylinder 35, which may be the stroke cylinder of a stacker truck in the present case. A consumer line 3c leads from the distributing valve 2 to the cylinder 35. A bleeding line 18 is branched off from the consumer line 3 to a load pressure bleeding connection 19 of the distributing valve 2.

A connecting duct 22 is provided in the control element 17, which is bifurcated in two branches 24, 25, which are jointly connected to a duct portion 23. As soon as the control element 17 has moved across e.g. 80% of its stroke in the direction to the final position, the fork branch 24 or the connection to the connection 20 is locked (outlined at 24a). Then there is only still the connection between the duct portion 23 and the fork branch 25. As customary a connecting duct 26 with an adjustable throttling point 27 is furthermore provided in the control element 17, which leads the pressure medium from the pump line 4 into the consumer line 3c.

The duct 28 of the control element 17 is set in the neutral position to the passage of the first control line 11 and also in the second control position b, in which the pressure medium can flow from the consumer line 3c directly into the return line 6. An auxiliary control line 32 leads from the line portion 30 to a precontrolled pressure relief valve 33, with which the system pressure in the control line circuit is limited and which is connected to the line 10 to the return line 6.

A cylinder 36 which can be acted upon on both sides with consumer lines 3a and 3b is connected to the next distributing valve 3 as consuming point, which can be alternatingly acted upon from the pump line. The second control line 12' to the distributing valve 3 which branches off from the line portion 30 is bifurcated and leads in each case to one load pressure bleeding of a consumer line 3a, 3b. It must be emphasized here that throttles 31 are disposed in the consumer lines 3a and 3b in the distributing valve, which limit the maximum conveying amount so that the cylinder 36 can only be moved at a limited speed. A second throttling point 15' is furthermore provided in the second control line 12'.

The distributing valve 3' which corresponds to the distributing valve 3 with the exception of the throttles 31 is of conventional construction and serves for controlling a double-sided cylinder 27. A second throttling point 15' is again provided in the second control line 12' to the distributing valve 3'. The throttle 15b and the throttling points 15' have e.g. in this embodiment the same throttle cross section.

The control device 1A according to FIG. 1 operates as follows:

The pump line 4 is locked in the represented neutral position of all distributing valves 2, 3 and 3'. The pressure medium flowing into the first control line 11 gets via the ducts 28 directly to the return line 6. The second control line 12 is thus freed from load so that the input pressure at the first throttling point 14 pressing the slide 8 of the pressure balance 7 into the passage position via the third control line 34, whereby the pressure medium from the pump line 4 flows directly into the return via the line 10. The pump must substantially only overcome the flow resistance caused by the weak spring 9.

As soon as the control element 17 of the distributing valve 2 is adjusted from the neutral position in an intermediate position (outlined with broken lines in FIG. 1) in direction to the first control position end position, the passage of the first control line 11 which is open to the return line 6 is interrupted. At the same time the connecting duct 22 connects the connections 19, 20 and 21. The duct 26 of the control element 17 connects the pump line 4 to the consumer line 3c. The load pressure in the consumer line 3c keeps the return valve 16 in the locking position. A pressure is built up in the second control line 12, which displaces the slide 8 of the pressure balance in the direction to the locking position. Thereupon the pressure in the first and also in the second control line 11, 12 increases until the return valve 16 is opened and pressure medium flows via the second throttling point 15 and the bleeding line 18 into the consumer line 3c. Due to the effect of the first and second throttling points 14 and 15 the pressure in the second control line 12 increases above the load pressure. The pressure adjusted in the pump line 4 by the pressure balance 7 becomes higher than the pressure in the consumer line 3c.

The input pressure of the second throttling point 15 is operative at the spring side of the pressure balance 7, which the input pressure of the first throttling point 14 acts on the opposite side of the slide 8. The pressure balance 7 regulates in this fashion in load pressure independent fashion the speed of the cylinder 35 adjusted with the control element 17. The input pressure of the second throttling point 15 results from the flow resistance of the two parallel throttles 15a and 15b so that an increase in pressure determined by the difference in pressure of the two input pressures and the spring 9 results.

As soon as the control element 17 is moved beyond e.g. 80% of its stroke path in the direction to the control position end position, the fork branch 24a of the connecting duct 22 is locked. The throttle 15b of the second throttling point 15 is thus inoperative. The pressure means in the second control line 12 flows only through the throttle 15a so that the flow resistance increases and with it also the input pressure operative at the spring side of the pressure balance 7. The pressure in the pump line 4 is further increased stepwise with respect to the consumer pressure, so that the desired maximum conveying amount is finally reached until the end position of the control element 17. The throttle 27 in the control element 17 acts as a measuring throttle, while the pressure balance 7 acts as an adjusting throttle, which controls the adjusted speed of the consuming point 35 in load pressure independent fashion.

The connecting duct 22 forms with the one throttle 15a or with the two parallel throttles 15a and 15b a pressure step D with which a steplike pressure increase is achieved If the distributing valve 2 is reversed in the other control position the control line circuit remains pressureless and the pump line 4 is directly connected to the return via the pressure balance 7. The pressure medium from the cylinder 35 flows off into the return duct 6.

If the distributing valve 3 is adjusted into one of its two control positions with the distributing valve 2 being left in the neutral position, the pressure balance 7 works as a function of the input pressures of the first throttling point 14 and the second throttling point 15' in the second control line 12' to the distributing valve 3. The increase in pressure remains approximately the same across the entire working range of the distributing valve 3. The maximum conveying amount of the cylinder 36 is limited in each working direction by the throttles 31, e.g. to 30 l/min.

The same applies to an individual operation of the distributing valve 3', for which the pressure balance 7 then works as a function of the input pressure at the first throttling point 14 and at the second throttling point 15' in the second control line 12'. No limiting of the maximum conveying amount is provided in the distributing valve 3'.

If in addition to the distributing valve 2 one of the distributing valves 3 or 3' or the two are actuated, the lowest load pressure has priority over the higher load pressures. This means that if e.g. the consumer line 3*a* of the distributing valve 3 carries the lowest load pressure, the pressure balance 7 works as a function of the input pressure at the first throttling point 14 and on the input pressure at the second throttling point 15' of the distributing valve 3. Even if the load pressure at the return valve 16 would be higher or the load pressure in the distributing valve 3', this higher load pressure cannot have any effect on the working of the pressure balance 7, because it is reduced via the second throttling point 15' in the distributing valve 3 relative to the amount of the load pressure prevailing there. This is in particular suitable in a stacker truck or a forklift, in which e.g. the distributing valve 3 controls the inclining cylinder, in whose movement a lower speed is to be observed even if there is a great load at the stroke cylinder (distributing valve 2). Since the pressure then prevailing in the pump line 4 is determined by the load pressure in the distributing valve 3, the cylinder 35 cannot move any great load and the speed of the cylinder 36 can also not be increased via the high load pressure in the distributing valve 2, even if the user of the forklift tries by actuating the distributing valve 2 to outwit the hydraulic control device. The principle of the stepwise pressure increase, possibly even for each consumer means could be used in all provided distributing valves.

Figure 2:
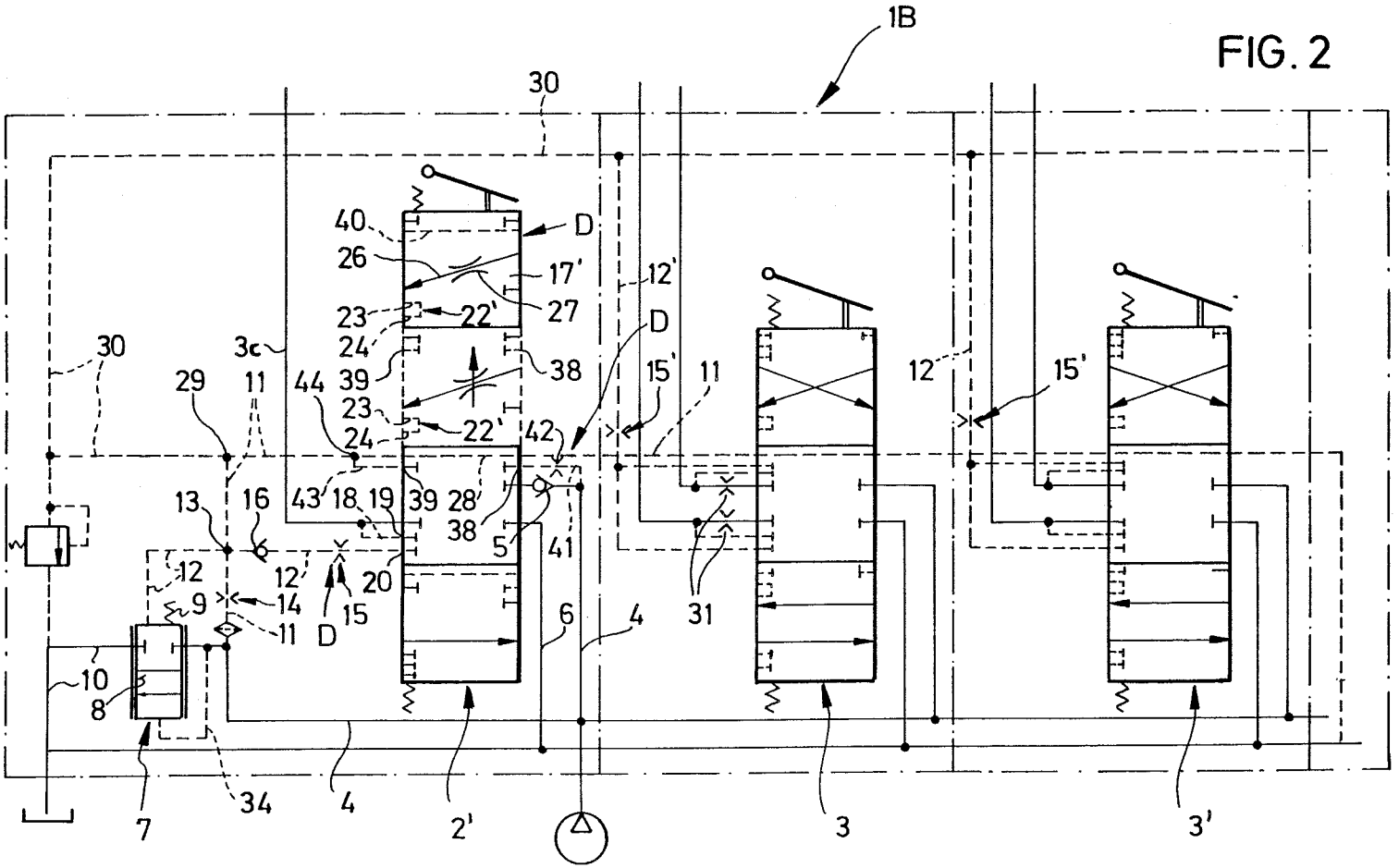
FIG. 2 shows a wiring diagram of a second embodiment of a hydraulic control device.

The hydraulic control device 1B according to FIG. 2 differs from that of FIG. 1 by a modification of the pressure step D for the input pressure at the second throttling point 15 or the spring side of the pressure balance 7. The first elements of the hydraulic control device 1B correspond largely to the ones described above, so that they are not dealt with in more detail.

The second control line 12 leads in FIG. 2 from the second throttling point 15 which is formed by a single throttle whose throttling cross section is smaller than that of the first throttling point 14 directly to the single load pressure bleeding connection 20 of the distributing valve 2' Adjacent to the same is the load pressure bleeding connection 10 of the bleeding line 18. The connecting duct 22' consists in the control element 17' only of the branch 24 and the connection 23. A continuous connecting duct 40 is additionally provided in the control element 17', to which a control duct inlet connection 38 is allocated in the distributing valve 2' at the side of the pump line 4 and opposite to the same a control duct outlet connection 39 in such fashion that the connections 38 and 39 are only connected in the case of a predetermined stroke path of the control element 17' in the direction to the first control position end position, e.g. as of 80% of the total stroke. The connections 38 and 39 are separated in the stroke path of the control element 17' between the neutral position and this predetermined stroke path (outlined with broken lines). A secondary control duct 41 branches off from the pump line 4 before the return valve 5 to the connection 38 and from the opposite connection 39 a connecting duct 43 branches off to an intersection 44 with the first control line 11. The connecting duct 43 could also be connected at another point of the control line circuit. A throttle 42 is disposed in the secondary control duct 41, whose throttling cross section is equal to the throttling cross section of the first throttling point 14.

In an intermediate position of the control element 17' between the neutral position and the first control position final position the bleeding line 18 is connected to the second control line 12 via the connecting duct 22'. The input pressure of the first throttling point 14 acts on one side of the slide 8, while the input pressure of the second throttling point 15 is operative on the spring side of the slide 8. The pressure increase is operative as a function of the input pressures of the throttling points 14, 15 so that the pressure in the pump line 4 exceeds the pressure in the consumer line 3*c* by a predetermined measure.

As soon as the control element 17' has exceeded a predetermined stroke path the duct 40 connects the connections 38 and 39. Thereupon pressure medium is additionally guided into the control line circuit via the then open flow path 41, 42, 38, 40, 39, 43, 11. Due to the additionally supplied pressure medium the flow resistance increases at the first throttling point 15, which ensures at the spring side of the slide 8 of the pressure balance 7 that there is a stronger throttling in the flow path from the pump line 4 to the line 10. An increasing difference in pressure between the pressure in the pump line 4 and the consumer line 3*c* results from this which ensures that the maximum conveying amount is achieved in the consumer line 3*c*. The input pressure present at the first throttling point 14 which acts upon the slide contrary to the spring 9 is not influenced by the pressure medium flowing into the control line circuit in the additional flow connection, because the throttle 42 has the same throttle cross section as the first throttling point 14.

If the control element 17' is again returned in the direction to the neutral position, the connections 38 and 39 are separated again as soon as the control element 17' gets e.g. to less than 10% of the stroke path. Then only the smaller increase in pressure is controlled until the neutral position is reached.

The cooperation with the further distributing valves 3 and 3' is effected in the same fashion as described by means of FIG. 1, i.e. the respectively lowest load pressure has priority over a higher load pressure because the control line circuit can reduce every higher load pressure via the load pressure bleeding of the distributing valve with the lowest load pressure. If the distributing valve 2' should be adjusted from the neutral position in the direction to the first control position, the pressure in the consumer line 3*c* is nevertheless not reduced, because the return valve 16 prevents this.

In the hydraulic control device 10 according to FIG. 3 in which only one distributing valve is shown a prestressed return valve 45 is disposed in the second control line 12, which combines on the one hand the second throttling point 15 and on the other hand the return valve 16 of the embodiment of FIG. 2. The connecting duct 22' in the control element of the distributing valve corresponds to the connecting duct 22 which was explained by means of FIG. 2 and which connects the bleeding line 18 both in an intermediate position of the control element and in the control position end position with the second control line 12. A pressure step is not represented in this embodiment.

FIG. 3A illustrates a detail variant in which a prestressed return valve 45' is accommodated in the bleeding line 18 from the consumer line 3c to the control element 17 of the distributing valve. This is a constructional simplification because the second control line 12 must not contain any elements responsible for pressure increase.

With the spring bias of the prestressed return valve 45 or 45' a certain drop in pressure can be adjusted via the prestressed valve, e.g. 15 bar. If the prestressed valve 45, 45' is designed in such fashion that the spring bias can be changed, the input pressure can be adapted to different conditions.

The effect of the pressure step D can be seen in the diagram of FIG. 4. The stroke path of the control element 17, 17' of the distributing valve 2, 2' is entered in percent on the vertical axis. The conveying amount Q is indicated on the horizontal axis. The lower full curve $P_{(3)}$ indicates the pressure in the consumer line 3c, while the upper full curve $P_{(4)}$ shows the pressure in the pump line 4. The dash-dotted curve T shows the course of the pressure in the pump line 4 of a conventional control device. The hatched area F represents the energy saving due to the effect of the pressure step D.

The diagram reveals that the pressure $P_{(3)}$ in the consumer line increases at first with an initially smaller conveying amount and then has an approximately linear course until the maximum conveying amount $Q_{max}$ is achieved. The pressure $P_{(4)}$ in the pump line 4 also increases at first with small conveying amount in order to then proceed substantially approximately constant with a higher value than the pressure in the consumer line 3c (first step of the pressure increase). At approx. 80% of the stroke path of the control element 17, 17' the pressure step becomes operative whereupon the pressure $P_{(4)}$ in the pump line 4 and thus the pressure difference to the pressure $P_{(3)}$ in the consumer line 3c increases up to a maximum value, which is reached before the maximum conveying amount $Q_{max}$ (second step of the pressure increase). In customary control devices of this type almost the complete pressure difference between the pressures $P_{(3)}$ and T is given already in the case of small conveying amounts, while according to the invention the pressure $P_{(4)}$ in the pump line 4 only is increased to this maximum value as of 80% of the stroke path of the control element 17, 17'. The hatched area F is that work or energy which is saved due to the effect of the pressure increase device. The relative courses of the curves of the diagram according to FIG. 4 can be coordinated with the respective applications by mutual coordination of the throttle cross sections. The coordination is always selected in such fashion that in the case of a smaller conveying amount the pressure difference between the pressure in the consumer line 3c and the pressure in the pump line 4 is sufficient to achieve the desired speed or conveying load in load independent fashion also in the case of a rapid operation of the distributing valve. However, at no time the maximum possible pressure is controlled in the pump line 4 in the case of a smaller conveying amount below the predetermined stroke position of the control element 17, 17', but only at higher or maximum conveying amounts.

We claim:

1. A hydraulic control device (1A, 1B, 1C) comprising at least one distributing valve (2, 2') connected upstream of a consuming point (35), whose control element (17, 17') locks at least one consumer line (3) in neutral position and connects the same in two control positions (a, b) alternatingly with a pump line (4) or a return line (6), a pressure source connected to the pump line (4), a pressure balance (7) connected to the pump line (4), a slide (8) loaded by a spring (9) in the direction to the locking position for the direct returning of the pressure medium conveyed by the pressure medium source (P) and not required by the consuming point (35) from the pump line (4) into the return line (6), a control line circuit branched off from the pump line (4) which has a first, a second and a third control line (11, 12, 34, 30), the first control line (11) leading from the pump line (4) to a relief connection, which is connected to the return line (6) in the neutral position of the distributing valve (2, 2'), while the second control line (12) leads from the spring side of the pressure balance (7) to at least one load pressure bleeding connection (20, 21) of the distributing valve (2, 2') and is connected to the first control line (119), the load pressure bleeding connection (20, 21) being connected to the consumer line (3c) in at least one control position (a) of the distributing valve (2, 2'), a first throttling point (14) disposed in the first control line (11) in the direction of flow to the distributing valve (2, 2') before the connection point (13) with the second control line (12), whose input pressure is transmitted via the third control line (34) to one side of the slide (8) of the pressure balance, and a second throttling point (15, 15') disposed in the second control line (12) behind the connection point (13), whose input pressure can be raised upon the adjustment of the control element (17, 17') from the neutral position and transmitted to the spring side of the slide (8) of the pressure balance (7) via the second control line (12), characterized in that the input pressure of the second throttling point (15) can be raised by means of the control element (17, 17') of the distributing valve (2, 2') as a function of its stroke in the direction to a control position end position prior to reaching the final position in at least two steps.

2. A hydraulic control device according to claim 1, characterized in that the second control line (12) is divided into at least two parallel branches (**12*a*, 12*b*) behind the connection point (13), each of which contains a throttle (15*a*, 15*b*) as part of the second throttling point (15) and leading to a separate load pressure bleeding connection (20, 21) of the distributing valve (2), and that a connecting duct (22) of the bleeding (18) is provided in the control element (17) of the distributing valve (2), which bifurcates to both load pressure bleeding connections (20, 21), whose one fork branch (24) can be locked by the control element (127**) prior to reaching the first control position end position

3. A hydraulic control device according to claim 1, characterized in that a secondary control duct (41) leads to a control duct inlet connection (38) of the distributing valve (2'), that a connection line (43) is provided from one control duct outlet connection (39) of the distributing valve (2') to the first control line (11) or to the control line circuit and that a passage (40) is provided in the control element (17') of the distributing valve, which connects the control duct connections (38, 39) upon the stroke of the control element (17') in leading fashion to reach the control position end position.

4. A hydraulic control device according to claim 2, characterized in that the two throttles (**15*a*, 15*b*) in the parallel branches (12***a*, 12*b*) are of a different size, that the sum of the throttle cross sections of the two throttles (15*a*, 15*b*) is smaller than the throttle cross section of the first throttling point (14) and that the fork branch (24) of the connecting duct (22) leading to the larger one (15*b*) of the two throttles (15, 15*b*) can be locked with the control element (17).

5. A hydraulic control device according to claim 4, characterized in that the first throttling point (14) has one diameter and the two throttles (15*a*, 15*b*) of the second throttling point (15) each have a smaller diameter, and throttle 15*b* has a smaller diameter than throttle 15*a*.

6. A hydraulic control device according to claim 3, characterized in that a throttle (42) is disposed in the secondary control duct (41) or in the connection (43), whose throttle cross section is equal to the throttle cross section of the first throttle (14).

7. A hydraulic control device according to claim 1 in which several distributing valves (2, 2', 3, 4) are connected in parallel to the pump line (4) and the control line circuit (11, 12, 30), characterized in that a return valve (16) locking contrary to the direction of flow to the distributing valve (2, 2') is disposed between the connecting point (13) and the second throttling point (15) in the second control line (12) at least in the distributing valve (2, 2') for the consuming point (35) to be supplied with the maximum pressure to be expected.

8. A hydraulic control device according to claim 3, characterized in that the second throttling point (15) is formed by a spring loaded prestressed return valve (45), which replaces the return valve (16).

9. A hydraulic control device according to claim 7, characterized in that the input pressure of the second throttling point (15, 15') can be raised to about 80% of the stroke path of the control element (17, 17') in the direction to the first control position end position to the second step.

10. A hydraulic control device according to claim 9, characterized in that the second throttling point (15) is disposed in a load pressure bleeding line (18) between the consumer line (3*c*) and the control element (17) of the distributing valve by a spring-loaded prestressed return valve (45').

* * * * *